US006098934A

United States Patent [19]

Skelton

[11] Patent Number: 6,098,934

[45] Date of Patent: Aug. 8, 2000

[54] DRINKING CONTAINER SUPPORT APPARATUS AND METHOD FOR INFANT FEEDING

[76] Inventor: Christie Lynn Skelton, 9732 Slater Avenue NE., Kirkland, Wash. 98033

[21] Appl. No.: 09/023,247

[22] Filed: Feb. 13, 1998

[51] Int. Cl.[7] ..... A47D 15/00

[52] U.S. Cl. ..... 248/102; 248/104; 248/106; 248/311.2; 297/188.21; 297/188.2

[58] Field of Search ..... 248/102, 103, 248/104, 105, 106, 311.2; 297/250.1, 188.2, 256.15, 188.05, 188.21, 188.06, 188.01; 224/647, 148.4, 148.5, 148.6; 2/49.1, 49.2, 49.3; D24/199; 211/119.007

[56] References Cited

U.S. PATENT DOCUMENTS

| | | | |
|---|---|---|---|
| D. 211,435 | 6/1968 | Kausen et al. . | |
| 1,567,225 | 12/1925 | Barbin | 248/102 |
| 2,134,746 | 11/1938 | Allen | 248/102 |
| 2,526,121 | 10/1950 | Curry et al. | 248/102 |
| 2,631,288 | 3/1953 | Daust | 248/102 X |
| 2,991,032 | 7/1961 | Theis | 248/102 |
| 3,773,287 | 11/1973 | Hechinger | 248/102 |
| 4,809,938 | 3/1989 | Skinner et al. | 248/102 |
| 4,895,327 | 1/1990 | Malone et al. | 248/102 |
| 4,953,816 | 9/1990 | Wilkinson | 248/102 |
| 5,022,616 | 6/1991 | Kordecki | 248/106 |
| 5,072,843 | 12/1991 | James | 248/102 X |
| 5,184,796 | 2/1993 | Maher | 248/104 |
| 5,217,192 | 6/1993 | Oktayuren | 248/102 |
| 5,820,084 | 10/1998 | Trumbauer et al. | 248/102 |

FOREIGN PATENT DOCUMENTS

| | | | |
|---|---|---|---|
| 2030121 | 5/1992 | Canada | 248/102 |
| 9607390A1 | 3/1996 | WIPO . | |

*Primary Examiner*—Anita M. King
*Assistant Examiner*—Naschica C Sanders
*Attorney, Agent, or Firm*—David V. Carlson; Seed IP Law Group PLLC

[57] ABSTRACT

The apparatus and method of this invention provide a versatile and convenient way to feed infants in a hands free manner while the infant is being transported, especially when being transported in an infant carrier seat. The invention provides a drinking container support apparatus comprised of a wedge shaped member, a drinking container retaining member and an strap for attaching the drinking container support apparatus to a carrier seat. The invention further provides for user selected adjustment of a drinking container to a position that is convenient and accessible to an infant. Another aspect of this invention is a method for feeding an infant while the infant is seated in an infant carrier seat by use of a drinking container support apparatus.

10 Claims, 8 Drawing Sheets

DRINKING CONTAINER SUPPORT APPARATUS AND METHOD FOR INFANT FEEDING

TECHNICAL FIELD

This invention relates to infant feeding support devices, and more particularly to a drinking container support apparatus for supporting an infant's drinking container that is attachable to an infant carrier seat and to methods of feeding an infant using the same.

BACKGROUND OF THE INVENTION

Bottle feeding an infant has it drawbacks and difficulties. The bottle must be retained in the correct position for the infant to drink, as well as being held at the correct angle. While the bottle is properly being held, the infant must still be encouraged to drink. The most convenient way used today is for an adult, such as a parent, to hold the baby in one hand and the bottle in the other. This provides comfort for the infant, as well as proper support and positioning of the bottle.

Unfortunately, it is not always possible for a parent to have two hands free for both holding and feeding a baby at the same time. For example, the parent may be walking with the child and need one hand free to carry other items. Further, infants are often placed in carrier seats for transportation, both in the parents arms and in an automobile. The law in many jurisdictions requires infants up to 40 pounds to be harnessed in a child seat whenever the vehicle is in motion. This means infants from newborn to approximately five or six years of age may be required to ride in a car seat, and these infants will often require feeding while positioned therein. Manufacturers and safety officials recommend that the safest position to secure an infant carrier is in the rear seat of the vehicle. That position makes it particularly difficult to attend to the feeding of an infant, especially when the only caregiver is the driver.

This difficulty often required the driver to stop the vehicle to give the child a bottle. When the infant is too young to grasp a feeding bottle, the caregiver must hold the bottle for the infant for the entire time necessary to satisfy the child's need. That delay becomes shorter when the child is old enough to grasp the bottle, in which case the caregiver may only need pause to place it in the hands of the child. Nonetheless, there is a stage when the infant is old enough to grasp the bottle, but not yet dexterous enough to keep hold of the bottle for a suitable feeding time.

Few infants complete drinking from a bottle in one uninterrupted session. More often they drink for several short periods punctuated with interim breaks and so require access to the bottle, on and off, for a prolonged period. A child often loses grip of the drinking container during this prolonged period, especially during the breaks. If in a car, the driver must make frequent stops to pick up a dropped bottle and additionally must contend with spills that result therefrom.

With the extended time that infant's spend in carrier seats, together with the comfort an infant receives while feeding from a bottle, being able to have the infant drink from a bottle while in the carrier seat provides a number of advantages. However, significant difficulties are encountered in attempting to bottle feed an infant while in a carrier seat. The problem is particularly acute when the carrier seat is for vehicular travel. Many carrier seats permit the child and seat to be secured in the automobile for safe travel and then upon arrival at the destination, all or part of the carrier seat may be removed for continued transport of the child in the same seat by a parent carrying the seat by a handle as they walk. However, the carriers are so bulky that it is hard to hold both the seat and a bottle in the correct position when extended feeding is desired.

Infant bottle supports of the prior art do not adequately address the needs for feeding an infant positioned in a carrier seat. In particular, the "Baby Bottle Holder" of U.S. Pat. No. 4,809,938, the "Bottle Holder For Infant Baby Bottles" of U.S. Pat. No. 5,217,192 and the "Infant Feeding Aid Apparatus And Method" of U.S. Pat. No. 4,895,327 do not provide means for attachment of the baby bottle support to ensure that the bottle can be retained in a proper position for use by the infant especially when seated in a carrier seat. In addition, these do provide adequate means for adjusting and positioning an infant feeding bottle or other drinking container for convenient access to the infant.

SUMMARY OF THE INVENTION

It is an object of this invention to provide an infant drinking container support apparatus for use in feeding an infant while in transport, and particularly when the infant is in a carrier seat.

This invention provides a drinking container support apparatus comprised of a support member having two surfaces, a first surface being generally flat, and a second surface being at an acute angle with respect to the first surface. The support member is preferably wedge shaped. The drinking container support apparatus further includes a strap connected to the support member that provides for attachment of the drinking container support apparatus to an infant carrier seat or alternatively to an article of clothing. Also included is a retaining member connected to the support member. The retaining member retains a drinking container in position on the second surface of the support member and further provides for user selected positioning of the drinking container on the apparatus.

Another aspect of this invention is a method for feeding an infant while the infant is seated in an infant carrier seat. The method comprises attaching an infant drinking container support apparatus to a carrier seat or article of clothing, inserting a drinking container into a retaining member on the drinking container support apparatus, and adjusting the drinking container to a user selected to permit liquid to be removed from the container by an infant either sucking on the nipple of a bottle, or drinking from a straw.

The apparatus and method of this invention provide a versatile and convenient way to feed infants in a hands free manner while the infant is being transported, especially when being transported in an infant carrier seat. These and other advantages will be apparent from the description that follows.

DETAILED DESCRIPTION OF THE INVENTION

Figure 1A:
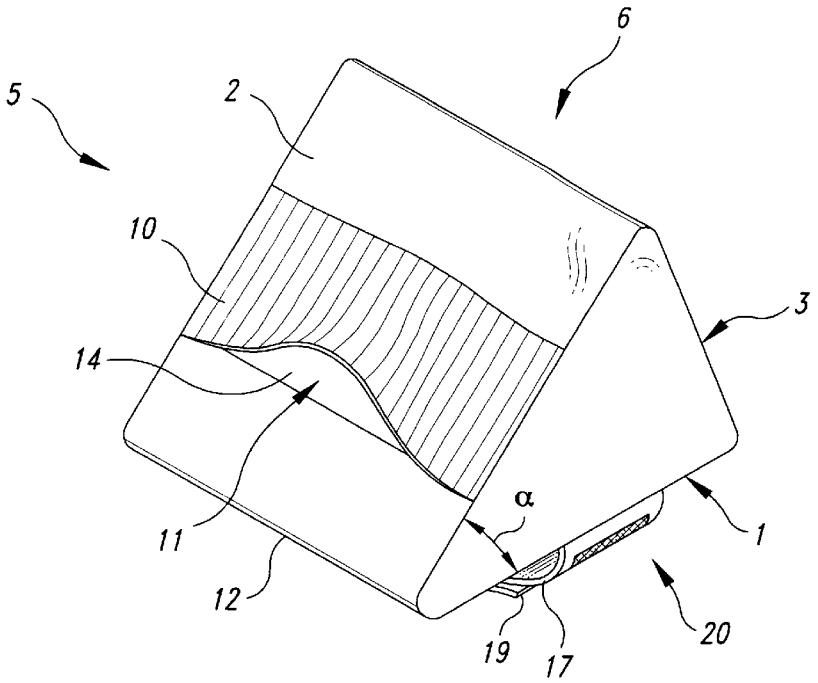
FIG. 1*a* is a front isometric view of a drinking container support apparatus according to a first embodiment.

FIG. 1 shows a front isometric view of a preferred embodiment of the drinking container support apparatus 5 of this invention. The drinking container support apparatus comprises a support member 6, retaining member 10 and strap 20. The support member 6 is comprised of a generally flat first surface 1, and a second surface 2, oriented at an acute angle with respect to the first surface. In the preferred embodiment, the drinking container support apparatus further includes a third surface 3, which is transverse to and contacting both the first and second surfaces, the three surfaces providing a wedged shape for support member 6. A proximate end 12 of the support member is located at a front junction between the first and the second surfaces. Acute angle provides that the second surface 2 is inclined with the proximate end 12 being at the lowest position of the incline. In a preferred embodiment, acute angle is in the range of 15° to 60° with about 30° being preferred for fulfilling the objectives of this invention.

Retaining member 10 is attached to the support member 6 and retains a bottle or other drinking container in contact with the second surface 2. In a preferred embodiment, retaining member 10 is attached to the second surface and is formed of an elastic material, preferably a ribbed elastic fabric. A space 11 is formed between the retaining member 10 and the second surface 2. In one embodiment, a gripping surface member 14 is further attached to the second surface 2. The gripping surface member 14 is made of a material selected to provide a frictional contact with a drinking container. A drinking container such as a baby bottle is inserted into space 11 with a lengthwise side of the drinking container in alignment with the second surface 2. The retaining member is sized so the space is capable of accommodating a plurality of drinking container dimensions. In the preferred embodiment, the retaining member is elastic and thereby, accommodates a variety of drinking container dimensions and further provides a mechanical force urging the drinking container into contact with the second surface of the support member.

Figure 1B:
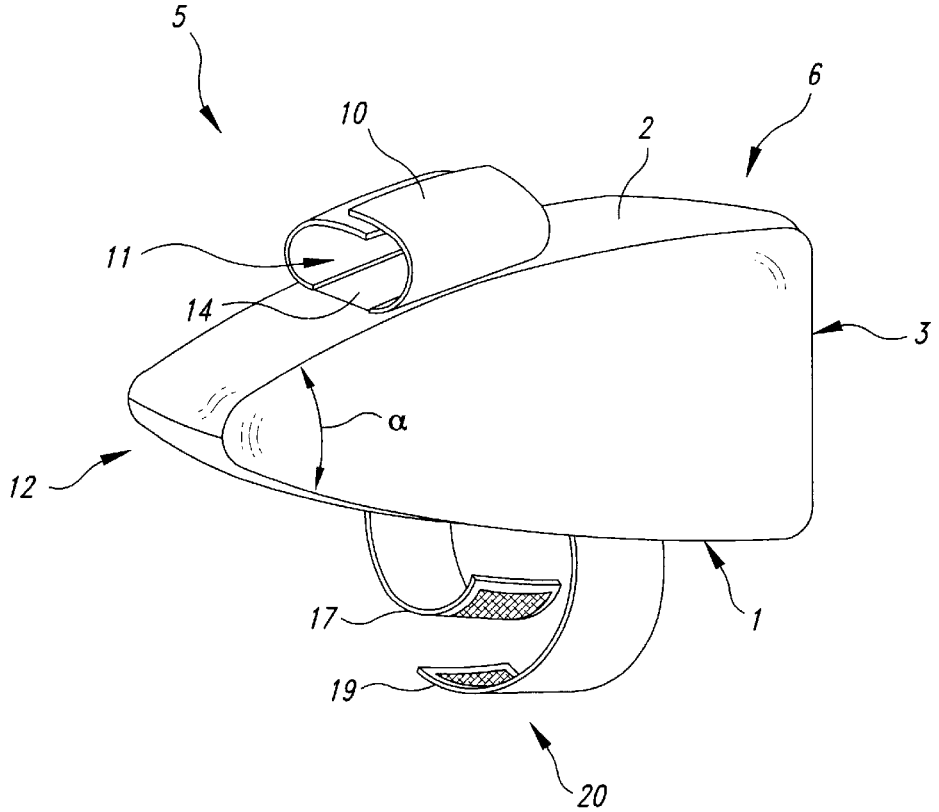
FIG. 1*b* is a front isometric view of the drinking container support apparatus according to an alternative embodiment.

FIG. 1*b* shows an alternative shape for the wedge. This is more a slender, torpedo shape. The angle is smaller, about 20° or less, both surfaces 1 and 2 are slightly cambered and extended in length relative to the embodiment shown in FIG. 1*a*.

Figure 2:
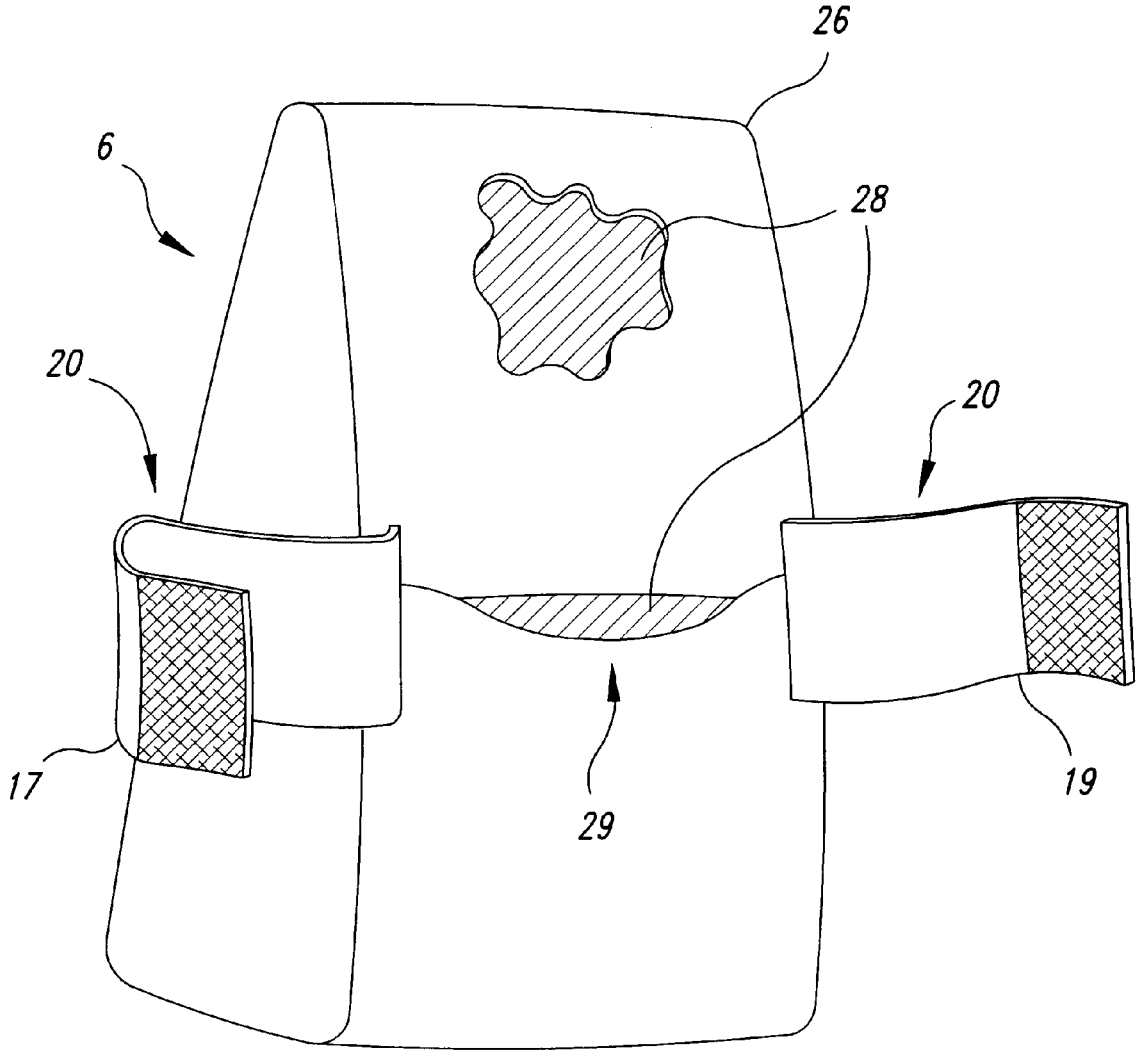
FIG. 2 is a bottom view of the drinking container support apparatus, illustrating an exterior jacket and removable interior filling.

Strap 20 provides for removable attachment of the support member 6 to an external component. In one embodiment the external component is part of an infant carrier seat, preferably a restraining harness of the infant carrier seat. The strap 20 is connected to the first surface 1 of the support member 6 and is comprised of two interconnectable strap members of adjustable length as illustrated in FIG. 2. The strap members are connected by any suitable method, including buckles, snaps, buttons, Velcro, or the like. The tightness of the strap is adjustable. This can be achieved in many ways, such as using interconnecting Velcro surfaces 17 and 19 on each respective strap member. Connecting and disconnecting of the Velcro surfaces thereby provides for both removable attachment of the support member to the restraining harness of the infant carrier seat, and for adjustable tightening of the attachment thereto.

FIG. 2 illustrates that in a preferred embodiment, the support member further includes an exterior jacket 26 and an interior filling 28. The interior filling can be removed and replaced inside the exterior jacket. The exterior jacket includes an opening member 29 whereby the interior filling is removed and replaced within the exterior jacket. In a preferred embodiment, the opening member comprises a slit in the exterior jacket. In the preferred embodiment, the interior filling is made from a compressible material, preferably foam rubber that is contoured to provide the desired surface dimensions and wedged shape of support member 6. In one alternative embodiment, the interior filling is a gas or a liquid inflatable bladder. Alternatively the external jacket comprises a bladder containing the gas or liquid. In an embodiment where the interior filling is a gas or liquid, the opening member is a valve. The removable interior filling allows the exterior jacket to be removed and cleaned in the absence of the interior filling if desired.

The weight of the drinking container support apparatus is selected to maintain the bottle in the correct position while avoiding discomfort for the infant. In some embodiments it may be desirable to put a small weight at one end or the other so as to provide balancing. In the preferred embodiment, there is no additional weight added and the interior material is made of the foam filling whose shape is held by the exterior cover. A weight in the range of 1–5 ounces has been found acceptable, with the weight preferably in the range 3–4 ounces so as to provide sufficient holding support for the bottle while being sufficiently light that it does not cause discomfort when placed for an extended period of time on the chest of an infant.

Figure 3:
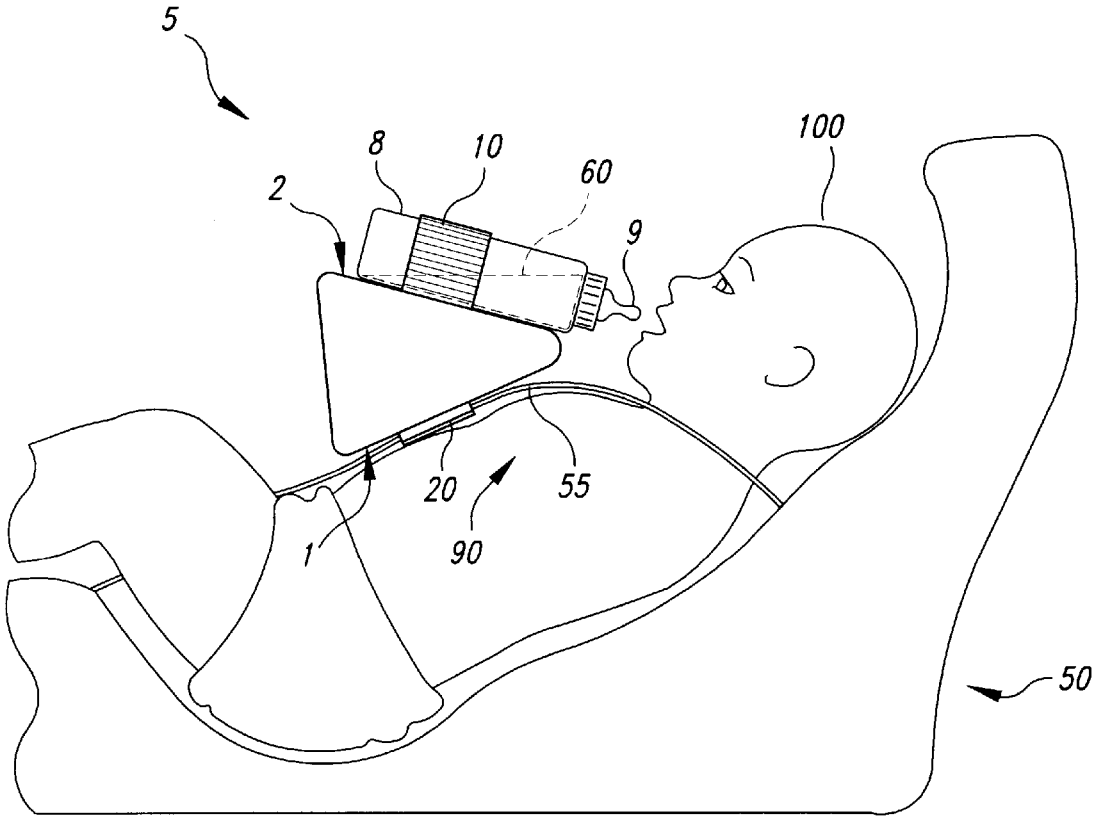
FIG. 3 is a side view of the drinking container support apparatus attached to a carrier seat and having a baby bottle positioned for infant feeding.

FIG. 3 shows a side view of a preferred embodiment of the drinking container support apparatus 5 in use by an infant 100. It is attached to a restraining harness 55, of an infant carrier seat 50, via strap 20. Infant 100, is seated in a reclined position in the infant carrier seat, and drinking container 8, such as a baby bottle, is inserted under the retaining member into the space 11 and retained against the second surface 2 by retaining member 10. In this position, the first surface 1, rests in proximity to the infants torso 90 and the baby bottle 8, is oriented with an outflow end 9 inclined downward and in proximity to the infant's mouth. This position promotes gravity flow of fluid 60 toward the outflow end of the baby bottle.

Figure 4A:
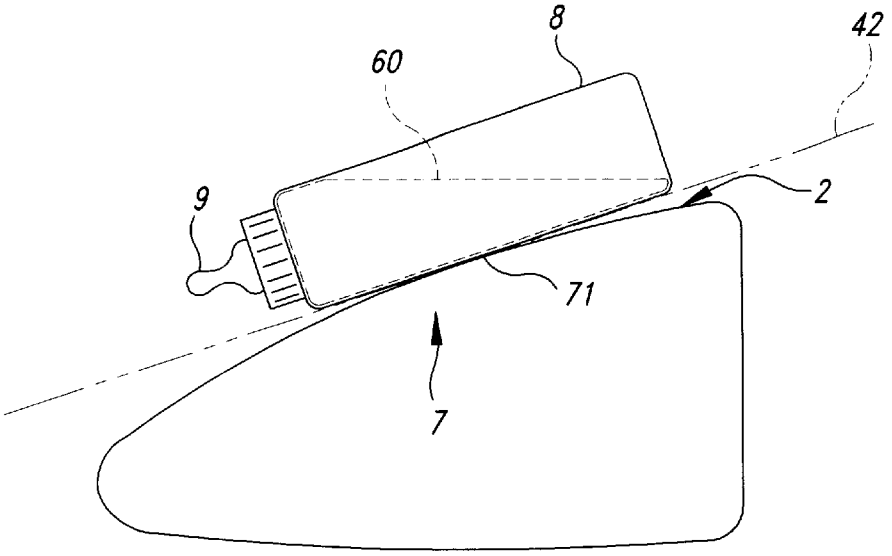
FIGS. 4*a* and 4*b* illustrate a cambered surface providing adjustable tilt to a baby bottle positioned on the drinking container support apparatus according to an alternative embodiment.
Figure 4B:
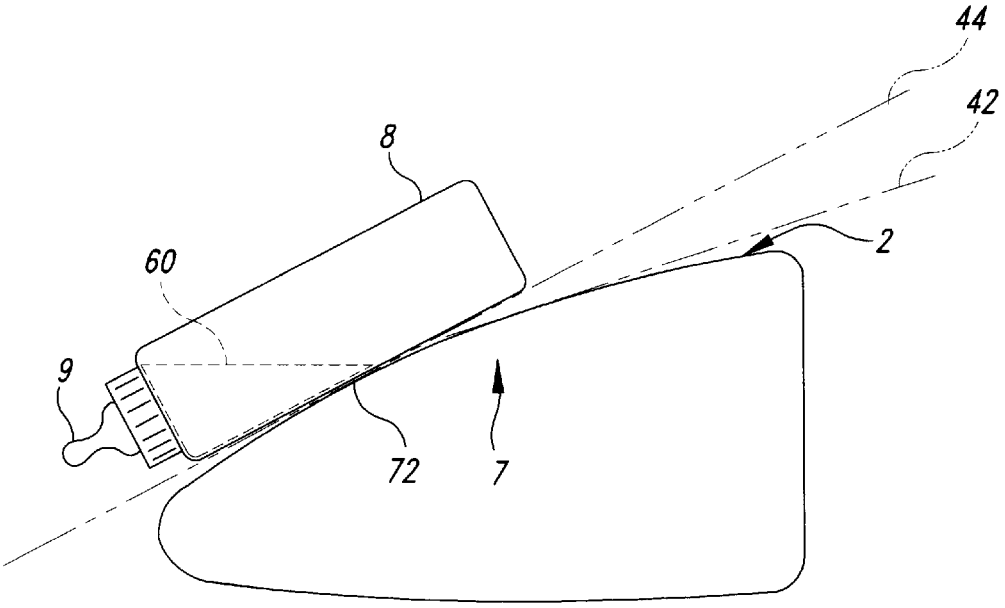

In a preferred embodiment, the second surface 2 of support member 10 has a slight camber 7 as illustrated in FIGS. 4*a* and 4*b*. A function of camber 7 is to provide for the outflow end 9 of the baby bottle 8 to be tilted from a first inclined position, shown by line 42, which is tangent to the camber at position 71, as shown in FIG. 4*a*, to a second, steeper inclined position shown by line 44, which is tangent to the camber at position 72, as shown in FIG. 4*b*. This adjustment in tilt is accomplished by moving baby bottle 8 downward along the camber of surface 2 as an amount of fluid 60 becomes less during drainage of the fluid by the infant's sucking. This adjustment in tilt provides for convenient repositioning the outflow end of the baby bottle during use of the drinking container support apparatus. Thus, while the surface 2 is preferably straight in most embodiments, in other embodiments, it can be slightly cambered.

Figure 5:
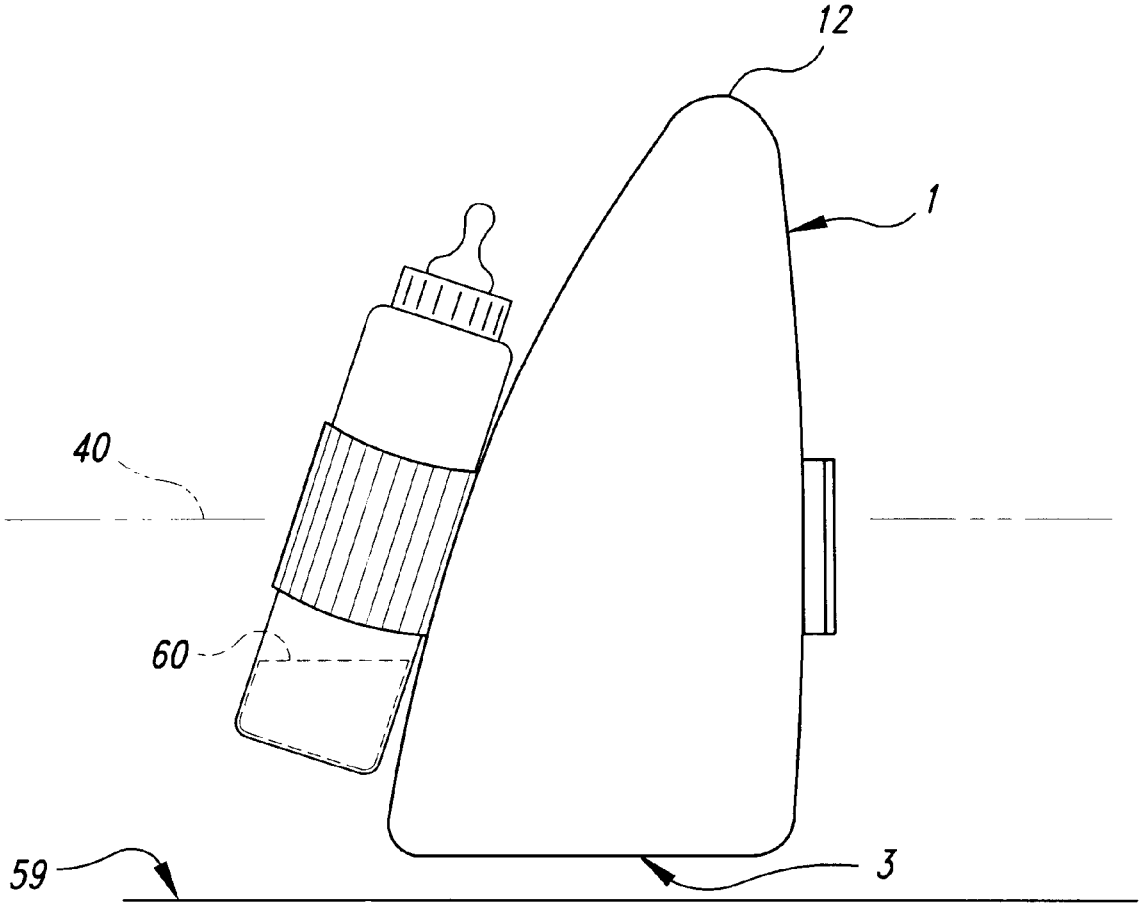
FIG. 5 illustrates an orientation of the drinking container support apparatus to hold the bottle in a storage position.

FIG. 5 illustrates another aspect of this invention in which the drinking container support apparatus can be positioned in a resting orientation. The drinking container support apparatus can be positioned in a resting orientation with the third surface 3 downward whereby the proximate end 12 of the support member is above a horizontal plane 40 rather than below the horizontal plane as when oriented for feeding. In the resting orientation, the drinking container support apparatus with attached baby bottle may be rested on surface 59 with the bottom down and the nipple up so that the fluid 60 is away from the outflow end, thereby preventing unwanted leakage from the baby bottle when it is not being used for feeding.

Figure 6A:
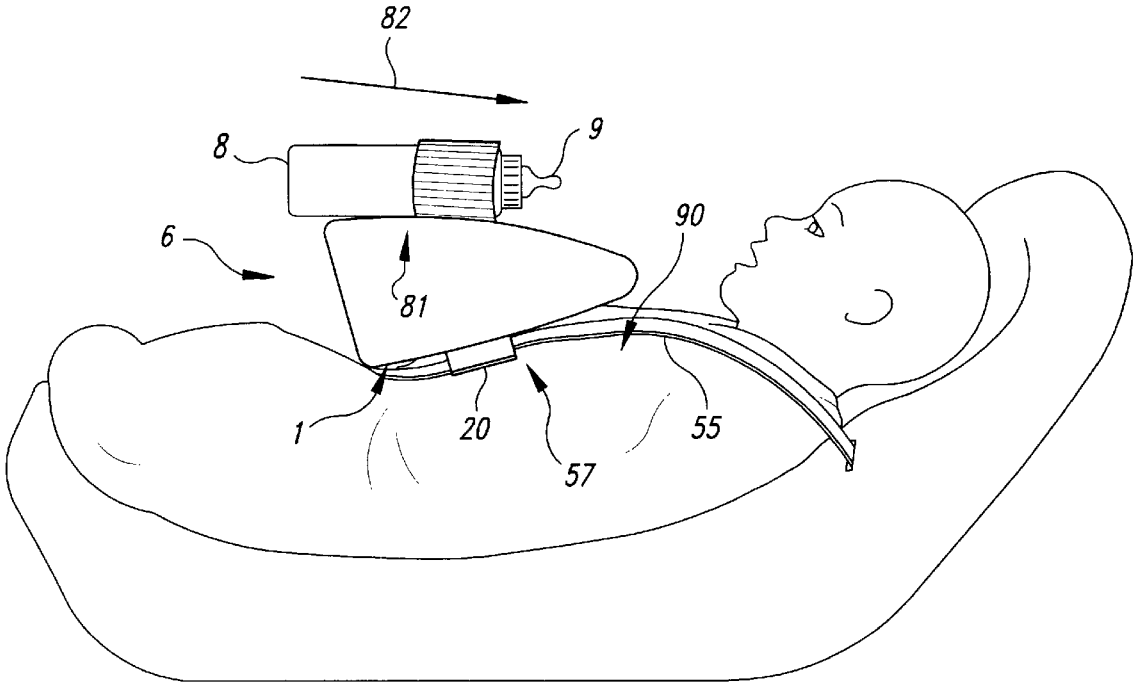
FIGS. 6*a* and 6*b* illustrate adjustable positioning of the drinking container support apparatus and attached drinking container.
Figure 6B:
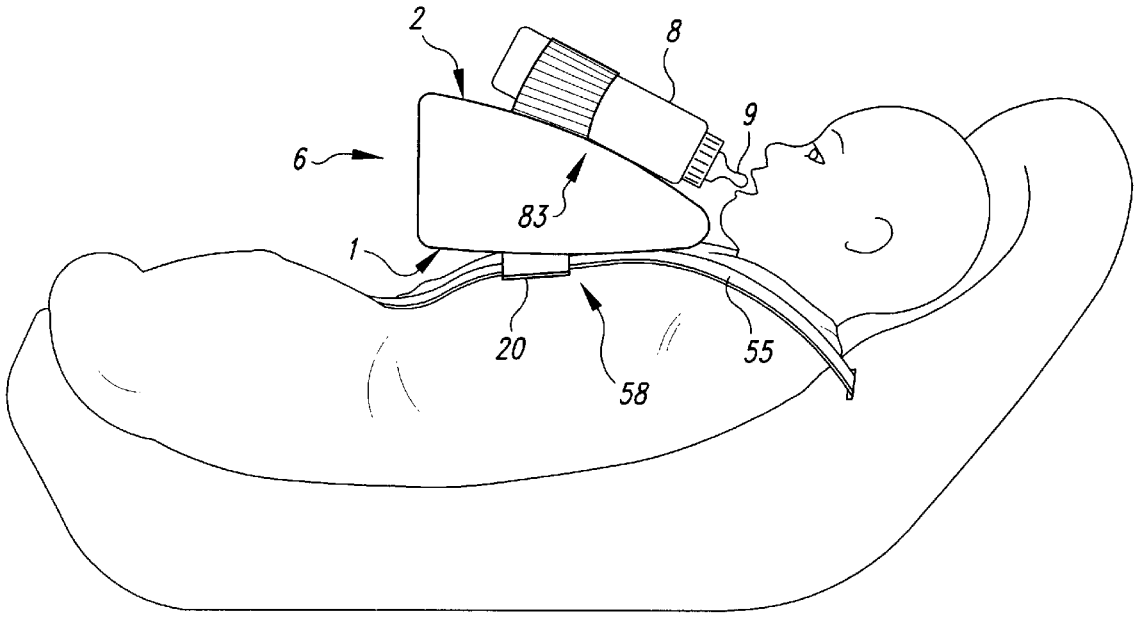

FIG. 6 illustrates two types of user selectable adjustments provided by the drinking container support apparatus of this invention. In a preferred embodiment, the retaining member 10 exerts sufficient tension against a baby bottle 8 to urge it into contact with the second support surface 2 and to stably maintain the drinking container at a first position 81 shown in FIG. 6A. The tension provided by the retaining member is sufficiently light to permit an infant or an adult to move the baby bottle upward, or downward 82, to a second user selected position 83 shown in FIG. 6B, said movement being along the incline defined by the second surface.

The strap 20 provides for user selected positioning of the drinking container support member 6 on the harness of an infant carrier seat. FIG. 6A shows the support member 6 attached at a first user selected position 57 with the first surface 1 lying proximately to the infant's torso 90 and where strap 20 is attached to harness 55 at position 57. In FIG. 6B the drinking container support apparatus is adjusted to a second user selected position 58 by movement of the strap to position 58 along the harness 55. This adjustment places the support member 6 at a different user selected position on the infant's torso 90 and further places the outflow end 9 of drinking container 8 in proximity to the infant's mouth. The user is thus able to easily place the bottle 8 in a plurality of user selected positions.

Figure 7A:
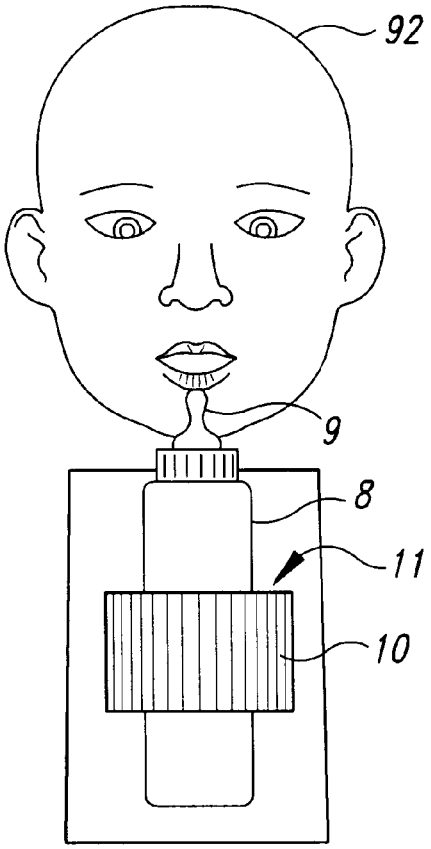
FIGS. 7*a* and 7*b* are top views of the drinking container support apparatus illustrating adjustable axial positioning of an attached baby bottle.
Figure 7B:
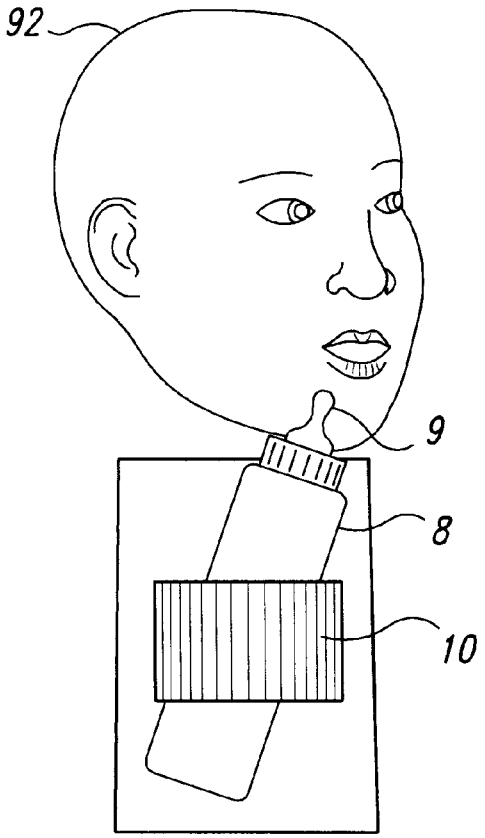

Similarly, FIGS. 7*a* and 7*b* show that the baby bottle may be positioned axially about an axis perpendicular to the plane of the second surface. This adjustment is accomplished by moving the bottle from a first user selected position illustrated in FIG. 7*a,* to a second user selected position illustrated in FIG. 7*b* The dimensions of space 11 and the tension provided by the retaining member 10 are such that the axial movement can be accomplished simply by the action of an infant turning its head 92 away from the first position of the outflow end of the baby bottle or by pushing it with his or her hand. In a preferred embodiment, the degree of axial movement permitted within the space is in the range of 10° to 45°, with approximately 30° being preferred to allow movement the outflow end of the bottle away from the infant's mouth yet keep it within easy reach of the infant's hands so that the infant may conveniently reposition the bottle for feeding at will.

Figure 8A:
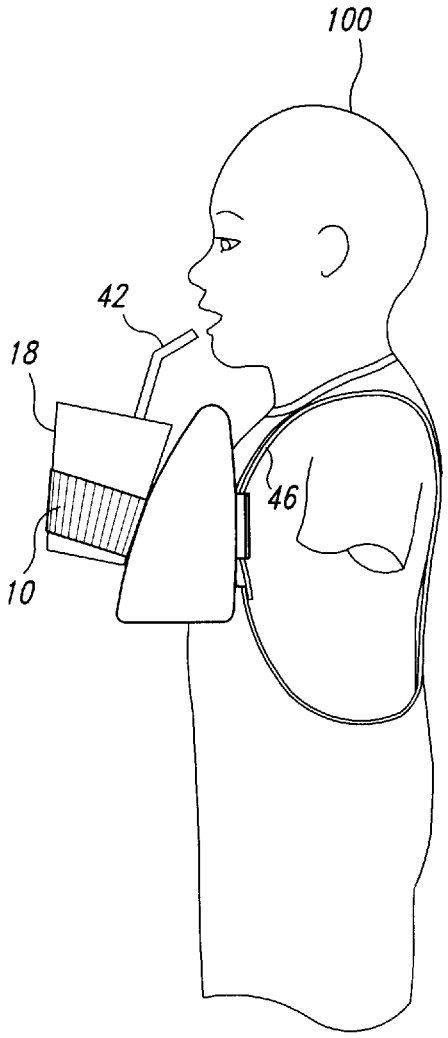
FIGS. 8*a* and 8*b* show alternative drinking containers and alternative attachments of the drinking container support apparatus.
Figure 8B:
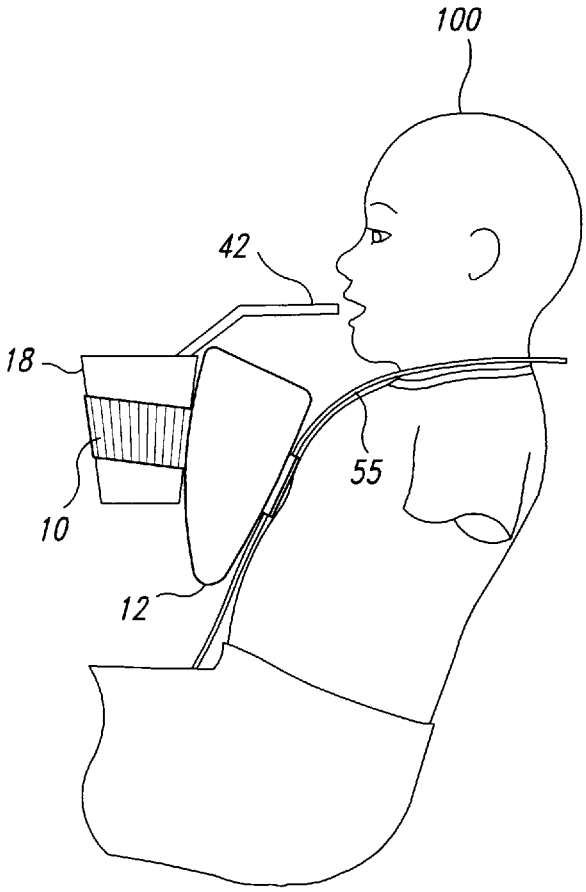

FIGS. 8*a* and 8*b* show that retaining member 10 also accommodates drinking containers other than baby bottles and further shows that strap 20 can be attached to an infant's clothing, or to carrier seats that secure the infant in an upright rather than a reclined position. FIG. 8*a* shows use of the drinking container support apparatus with drinking container 18 having a straw 42 at the outflow end, and where the infant 100 is standing. FIG. 8*b* shows use of the drinking container support apparatus where the infant is seated in an upright position. When the infant is standing, the strap 20 is attached to an article of clothing such as suspenders 46. When the infant is seated in an upright position the support member 6 is attached to the harness of a carrier seat 55 as in FIG. 3, but may be attached in an inverted orientation as shown in FIG. 8*b* so that proximate end 12 is pointed away from the infant's mouth. In this position the drinking container 18 is oriented upright with the outflow end of straw 42 being near the infant's mouth. In these alternative orientations, similar adjustment to a user selected position may be accomplished by movement of the drinking container or attachment position of the support member as described above and shown in FIG. 6.

Another aspect of this invention is a method for feeding an infant from a drinking container while the infant is positioned in an infant carrier seat. The practice of this method comprises the steps of attaching a drinking container support apparatus to an external device in proximity to an infant; inserting a drinking container into a retaining member of the drinking container support apparatus; and adjusting the drinking container support apparatus to permit an infant to drink from the container. In a preferred embodiment, the external device is an infant carrier seat and attachment of the drinking container support apparatus is to a harness of the carrier seat. In another embodiment, the external device is an article of clothing such as suspenders and the drinking container support apparatus is attached to the article of clothing. In either embodiment, the adjustment provides user selected positioning of the drinking container so that it accessible to the infant's mouth.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A method for feeding an infant from a drinking container while the infant is positioned in an infant carrier seat, the method comprising the steps of:

attaching a drinking container support apparatus to an infant seat, at a first location, using a first strap and a second strap that extend around a portion of the infant seat, the drinking container support apparatus having a support member composed of a solid foam rubber, the support member in the form of a wedge shape, the support member including a first surface, a second generally flat surface at an acute angle to the first surface and a third surface transverse to the first and the second surfaces, the three surfaces forming a triangular shaped wedge member, the support apparatus having a cover member extending over and enclosing the support member, the cover member also being of a triangular wedge shape so as to conform closely to the preformed, wedge shape of the solid, support member, the cover having a first surface, a second surface and third surface corresponding respectively to the first, second and third surface of the support member, a high friction, gripping strip connected to the second surface of the cover member the frictional gripping surface member having a higher friction, and gripping capability than the cover;

a broad, elastic member extending above the frictional gripping surface member, the broad elastic member extending transversely across the second surface and above the frictional gripping surface member so as to provide a retaining space into which a baby bottle may be inserted and firmly gripped between the elastic member and the frictional gripping surface member;

the first strap extending from the third surface of the cover, the first strap having a fastening member connected thereto and extending under a portion of the infant seat;

the second strap being connected to the third side, the second strap having a fastening member connected thereto and extending under a portion of the infant seat such that the first and second straps are connected to each other to extend around a portion of the infant seat and securely maintain the cover having the support member therein to the carrier seat but not wrap around the body of an infant;

inserting a drinking container into the retaining space between the elastic band and the frictional gripping surface so as to retain the drinking container;

moving the drinking container to a second location on the infant carrier seat by moving it relative to the infant seat while connected to the infant seat, the first and second straps being movable relative to the infant seat; and adjusting the drinking container to a selected position on the drinking container support apparatus to permit liquid to be removed from the bottle by an infant sucking on the drinking container.

2. The method of claim 1 wherein the selected position of the drinking container is accessible to the infant's mouth and hands.

3. The method of claim 1 wherein the adjusting is accomplished by at least one of, adjusting a position of the drinking container within the retaining member; and adjusting the position of attachment of the drinking container support apparatus to the harness.

4. An apparatus for supporting a baby bottle as attached to an infant seat, comprising:

a support member that is preformed into a triangular wedge shape, the support member including a first surface, a second generally flat surface at an acute angle to the first surface and a third surface transverse to the first and the second surfaces to form a triangular shaped wedge member of a solid material that has been preformed into the triangular wedge shape;

a cover member composed of a first material extending over and enclosing the support member, a cover member also being of a triangular wedge shape so as to conform closely to the preformed, wedge shape of the solid, support member, the cover having a first surface, a second surface and third surface corresponding respectively to the first, second and third surface of the support member;

a high friction, gripping strip connected to the second surface of the cover member and the frictional gripping surface member being composed of a second material and having a higher friction, and gripping capability than the cover material;

an elastic member extending above the frictional gripping surface member, the elastic member extending transversely across the second surface and above the frictional gripping surface member so as to provide a retaining space into which a baby bottle may be inserted and firmly gripped between the elastic member and the frictional gripping surface member;

a first strap extending from the third surface of the cover, the first strap having a fastening member connected thereto and having a length that is sufficiently long to connect to another strap;

a second strap connected to the third side, the second strap having a fastening member connected thereto and having a length sufficiently long to connect to and be fastened with the first strap around a portion of an infant seat and being moveable with respect to the infant seat when connected to the first strap and fastened to the infant seat.

5. The apparatus according to claim 4 wherein the solid material is a foam rubber.

6. The apparatus according to claim 4 wherein the solid support members has an angle of curvature along the first surface for permitting the bottle positioned thereon to be gripped at different angles depending on the position of the bottle with respect to the first surface.

7. The apparatus according to claim 4 wherein this acute angle is selected to be about 30°, the solid member being preformed to have an angle in the range of 30° between the first surface and the second surface and the cover having a similar angle so as to match with and conform to the preformed solid support member.

8. The apparatus according to claim 1 wherein the first and second strap extending from the third side connect around a seat strap connected to the seat that extends over the chest of the infant seat.

9. The apparatus according to claim 4 wherein the first and second strap extending from the third side connect around a seat strap connected to the seat that extends over the chest of the infant seat.

10. An apparatus for supporting a baby bottle as attached to an infant carrier, comprising:

a support member that is preformed into a triangular wedge shape, the support member including a first surface, a second generally flat surface at an acute angle to the first surface and a third surface transverse to the first and the second surfaces to form a triangular shaped wedge member of a solid material that has been preformed into the triangular wedge shape;

a cover member composed of a first material extending over and enclosing the support member, a cover member also being of a triangular wedge shape so as to conform closely to the preformed, wedge shape of the solid, support member, the cover having a first surface, a second surface and third surface corresponding respectively to the first, second and third surface of the support member;

a high friction, gripping strip connected to the second surface of the cover member, the frictional gripping surface member being composed of a second material and having a higher friction, and gripping capability than the cover material;

an elastic member extending above the frictional gripping surface member, the elastic member extending transversely across the second surface and above the frictional gripping surface member so as to provide a retaining space into which a baby bottle may be inserted and firmly gripped between the elastic member and the frictional gripping surface member;

a bottle, the bottle being positioned between the elastic strap and the gripping surface;

a high friction, gripping strip connected to the second surface of the cover member the frictional gripping surface member having a higher friction, and gripping capability than the cover;

a broad, elastic member extending above the frictional gripping surface member, the broad elastic member extending transversely across the second surface and above the frictional gripping surface member so as to provide a retaining space into which a baby bottle may be inserted and firmly gripped between the elastic member and the frictional gripping surface member;

a first strap extending from the third surface of the cover, the fist strap having a fastening member connected thereto and having a length that is sufficiently long to connect around a strap;

a first strap extending from the third surface of the cover, the first strap having a fastening member connected thereto and having a length that is sufficiently long to connect to another strap;

a second strap connected to the third side, the second strap having a fastening member connected thereto and having a length sufficiently long to connect to and be fastened with the first strap around a portion of the infant carrier such that when the first and second straps are connected to each other they are adapted to securely maintain the cover having the support member therein to the infant carrier and being movable with respect to the infant carrier while connected thereto.

* * * * *